United States Patent [19]

Kaessner et al.

[11] 4,213,713

[45] Jul. 22, 1980

[54] ONE PIECE AGITATOR FOR CLOSED VESSEL

[75] Inventors: Hugo Kaessner, Schwetzingen; Wilhelm Loehr, Oftersheim, both of Fed. Rep. of Germany

[73] Assignee: Pfaudler Werke A.G., Schwetzingen, Fed. Rep. of Germany

[21] Appl. No.: 962,110

[22] Filed: Nov. 20, 1978

[30] Foreign Application Priority Data

Nov. 19, 1977 [DE] Fed. Rep. of Germany ..... 2751770
Nov. 19, 1977 [DE] Fed. Rep. of Germany ... 7735483[U]

[51] Int. Cl.[2] ..... B01F 7/16
[52] U.S. Cl. ..... 366/279; 366/343
[58] Field of Search ..... 366/279, 280, 315-317, 366/342, 343; 416/202, 207, 208, 223 R, 237, 241 R, 241 B

[56] References Cited

U.S. PATENT DOCUMENTS

| | | | |
|---|---|---|---|
| 2,039,277 | 5/1936 | Baehr | 366/347 |
| 2,636,720 | 4/1953 | Forrest | 416/208 |
| 2,991,051 | 7/1961 | Jones | 366/279 |
| 3,751,013 | 8/1973 | Schroeder | 366/343 |
| 3,796,512 | 3/1974 | Djuvik | 416/202 |
| 4,065,107 | 12/1977 | Van Horbek | 366/343 |

FOREIGN PATENT DOCUMENTS

| | | | |
|---|---|---|---|
| 682898 | 11/1952 | United Kingdom | 366/279 |
| 775363 | 5/1957 | United Kingdom | 366/279 |
| 1500116 | 2/1978 | United Kingdom | 366/279 |

*Primary Examiner*—Leonard D. Christian
*Attorney, Agent, or Firm*—Theodore B. Roessel; James A. Rich

[57] ABSTRACT

A one piece enameled agitator is equipped with an impeller that can be wound or threaded through an opening in an associated container or vessel that is smaller than the impeller diameter.

18 Claims, 6 Drawing Figures

ONE PIECE AGITATOR FOR CLOSED VESSEL

BACKGROUND OF THE INVENTION

This invention relates to a one-piece agitator, preferably enameled, for use in closed enameled vessels having manhole openings therein.

There are three general types of enameled vessels. In one type, frequently referred to as a two piece or clamp top vessel, the entire top head of the vessel can be removed. This facilitates installation of internal components such as agitators and baffles. However, this type of construction increases construction costs and magnifies sealing problems, particularly since adjustments of the seals may be necessary because of distortions of the vessel flanges during enameling of the vessel.

Another type of vessel, sometimes referred to as a one piece vessel with an assembly opening, uses a top head formed integrally with the body of the vessel, but with a relatively large opening in the head through which agitators and the like can be installed. Thus, relatively large container openings are still necessary, with the attendant production costs and sealing problems.

The third type of vessel, frequently referred to as a one piece or closed vessel, features an integral top head with relatively small openings such as pipe connections, openings for agitator and/or baffle shafts, and manhole openings. The largest opening in a vessel of this type is usually the manhole, which is typically much too small to admit a conventional one piece agitator of the size that would be desirable for many applications. Thus, although this type of reactor minimizes the construction costs and sealing problems presented by the clamp top vessel and the one piece vessel with the large assembly opening, it limits the type of agitator that can be installed in the vessel.

Separable enameled agitators—with individual elements that can be introduced through a relatively small opening such as a manhole and assembled inside the vessel—avoid the foregoing problems. Unfortunately, since the seals on these separable agitators are relatively inaccessible and difficult to examine, and since these agitators are frequently exposed to highly corrosive conditions, it is difficult and expensive to provide reliable seals for these separable enameled agitators. Moreover, even in the case of very expensive sealing constructions, the connection points on the agitators form weak points where breakdowns can occur.

SUMMARY OF THE INVENTION

It is an object of this invention to provide a one piece agitator that may be completely enameled and then inserted through an opening in a closed vessel, such as a manhole, which is considerably smaller than the diameter of the agitator impeller and which provides agitation comparable to other enamelled agitators.

These objects are achieved by using an agitator with an impeller that can be wound or threaded through the manhole opening. In a preferred embodiment, a plurality of agitator blades are mounted on a ring segment which in turn is connected directly to the agitator shaft, preferably through an offset portion at the lower end of the shaft. Since this impeller can be threaded through a relatively small opening, such as a manhole, it can have an outer or circumferential diameter several times larger than the greatest cross-section dimension of the manhole, and still be inserted through a conventional manhole in a closed vessel. Further advantages of this one piece agitator construction, which can be completely enameled, are that the impeller blades can be curved to form a retreat curve impeller and can be positioned near the bottom of the vessel, and that, particularly with highly viscous products, an additional mixing affect is obtained through the offset formation of the agitator shaft.

DRAWINGS

DETAILED DESCRIPTION

Figure 1:
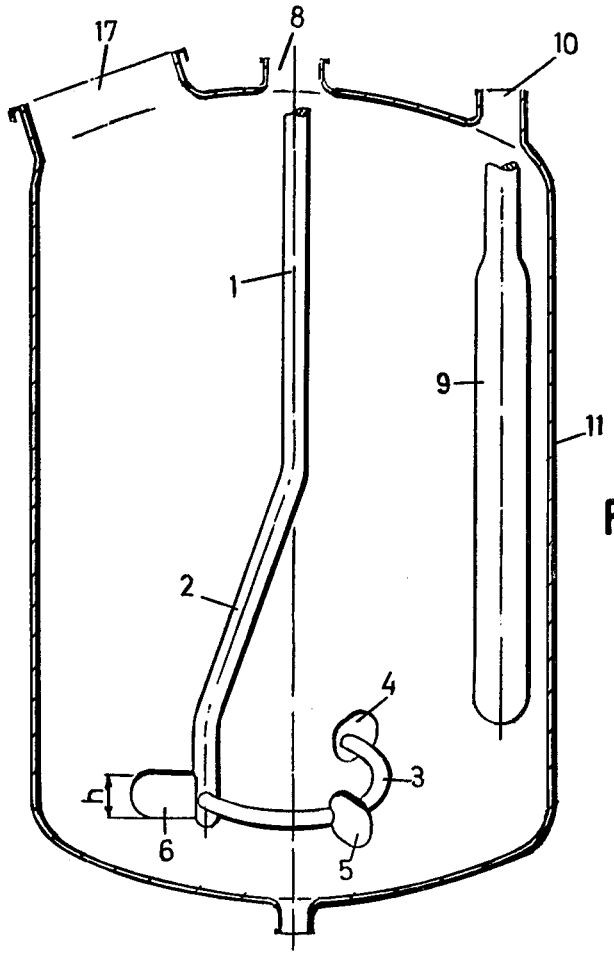
FIG. 1 is a schematic sectional elevation view of a vessel containing an embodiment of this invention, with the agitator shown in perspective.
Figure 2:
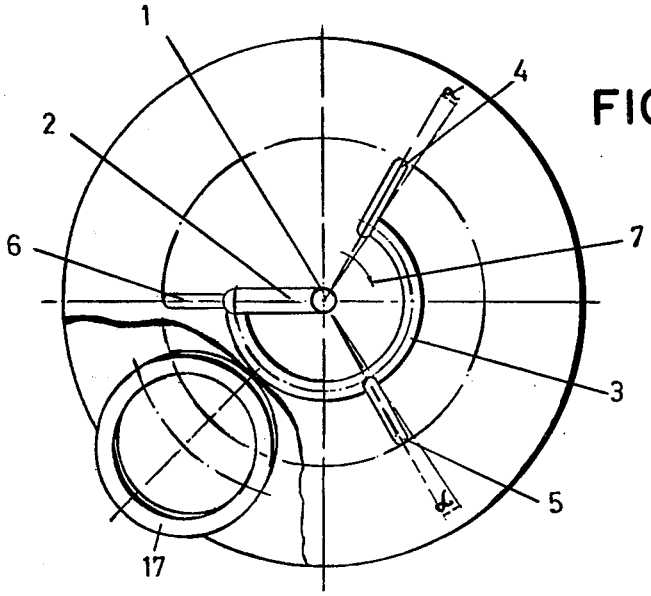
FIG. 2 is a schematic plan view of the vessel and agitator shown in FIG. 1.

FIGS. 1 and 2 illustrate a preferred embodiment of this invention, with a one piece, completely enameled agitator mounted inside a typical closed enameled vessel 11. A manhole 17 and an agitator mounting nozzle 8 are provided in the top head of the vessel 11. An agitator shaft 1 extends through the agitator nozzle 8. The lower portion 2 of the agitator shaft is offset, and the agitator impeller is attached to the lower end of the offset shaft connection 2. The impeller comprises a ring shaped segment 3 and three agitator blades 4, 5 and 6 extending from the ring segment 3. The agitator blades and the ring shaped segment 3 may all lie in a plane perpendicular to the axis of the agitator shaft 1, as illustrated in FIG. 1. However, the agitator blades 4, 5 and 6 may also be inclined slightly upwards to conform to the generally conical shape of the bottom of the vessel 11 if it is desirable to position the agitator as close to the bottom as possible.

As may be seen from FIGS. 1 and 2, there is an opening in the ring segment 3 which allows the ring segment to be threaded through the manhole 11. With the illustrated three blade impeller, the cut out section may be approximately 120°. The agitator blades may be symmetrically arranged on the ring segment 3 with respect to rotation, however, it may be desirable to displace some of the agitator blades slightly from a symmetrical arrangement to help balance moments on the agitator, as will be explained in greater detail below.

Of course, more than three agitator blades may also be used. Generally, the agitator blades will be provided in the number and form desired for various mixing processes. A preferred form has three blades, flattened to increase the heighth of the blades, with the tips curved away from the direction of rotation of the impeller. This type of construction, frequently referred to as a retreat curve impeller, helps to circulate the material being mixed throughout the vessel. With three flattened retreat curve agitator blades mounted on a ring segment such as the one illustrated in FIGS. 1 and 2, the mixing effect obtained is comparable to that obtained with a conventional retreat curve impeller.

The maximum length of the agitator blade can be chosen equal to the greatest diameter of the manhole 17, less the necessary space for insertion of approximately 30 to 50 mm. In order to provide an optimal assembly, a portion of the agitator shaft fastened to the ring segment 3 may first run for a certain distance parallel to the agitator axis, as illustrated in FIG. 1. This type of agitator can be directly mounted through an ordinary manhole opening 17 of a one piece container. Thus, insertion and mounting of the agitator does not require any openings larger than the manhole opening that is usually present.

An agitator drive mechanism (not shown) is generally attached to the agitator above the agitator mounting nozzle 8. Also, a conventional finger shaped, D-shaped or paddle shaped baffle 9 is typically used with the agitators of this invention. The baffle 9, which can also be inserted through the manhole opening 17, is mounted in a conventional baffle mounting nozzle or opening 10.

Because of the special construction of the agitators of this invention, moments are produced at the point where the agitator is supported in nozzle 8, arising both from the forces of flow and also from centrifugal forces. These moments should be compensated for or balanced to insure satisfactory functioning of the shaft sealing, and to avoid the need to oversize the agitator shaft and/or drive unit to prevent overloading in case greater drive powers are required.

The flow forces on the offset portion 2 of the agitator shaft generate moments on the agitator in different planes perpendicular to the axis of rotation. The moments on the agitator shaft and/or the agitator mounts and seals arising therefrom can be compensated for by slightly varying the height of one or more of the agitator blades 4, 5 and 6 relative to the other blades or, as is shown in FIG. 2, by mounting some of the agitator blades in a position that deviates from a symmetrical arrangement by a small angle, for example 5°. Either of these measures cause a resulting force in the area of the agitator blades, which can compensate for the moment on the agitator shaft arising from the forces on the offset shaft connection 2. The remaining uncompensated transverse forces do not affect the functioning of the agitator.

In a similar way, the imbalances arising from the lack of symmetry of the impeller can be compensated for by varying the thickness of one or more of the agitator blades 4, 5, 6 or the thickness of the ring shaped segment 3. The weight of certain parts of the impeller may also be varied by other means, as for example, mounting additional masses on one or more agitator blades, so that no undesired moment influences the agitator shaft.

The moment arising at the point of connection between the ring shaped segment 3 and the shaft connection 2 may be controlled without special difficulties. A partial compensation for the moment at this location, which is produced by flow forces and centrifugal forces, is obtained by arranging the ring shaped segment 3 so that it follows the shaft connection 2 in the direction of rotation 7. With this arrangement, the resultants of the forces of flow and the centrifugal forces act in opposite directions, which reduces the moment at the point where the ring segment joins the shaft connection 2.

An agitator of this sort can be completely enameled, because of its construction favorable to enameling technique, without fear of chipping, which could be caused through excessive stresses generated in the enameling process or in the operation of the agitator. This produces significant advantages in the economy of using a vessel according to this invention, because it is desirable, particularly in highly corrosive chemical applications at high temperatures under high pressures, to avoid the seals and weak points which were characteristic disadvantages of known segmented enamel agitators.

FIGS. 3–6 show other versions of this invention which may also be threaded through a conventional sized manhole 17 in a closed vessel 11. In each of these agitators, the impeller is constructed of alternating sections running at least approximately horizontally and sections running at least approximately vertically. In the agitator represented in FIG. 3, the impeller is essentially made S-shaped in that the agitator blades 14, 15, 16 are arranged horizontally and superimposed above one another, and are connected with each other by vertical connecting arms 12, 13 which are offset from the axis of the agitator shaft 1. The impeller of the agitator shown in FIG. 4 could be considered as a partial S-shape or as a C-shape with an additional agitator blade attached essentially vertically at the lower end of the impeller.

Figure 3:
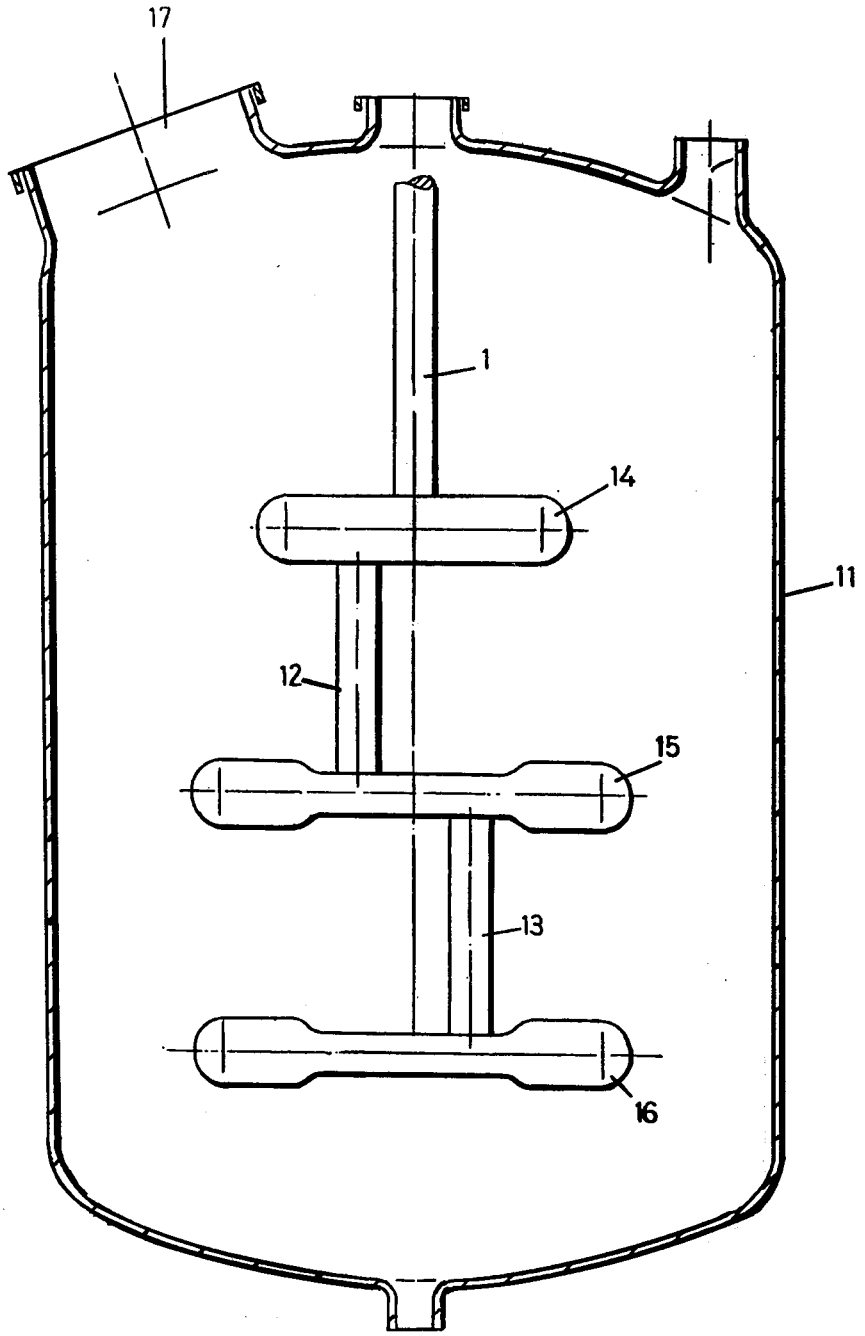
FIGS. 3–6 are schematic elevation views of other embodiments of this invention.
Figure 4:
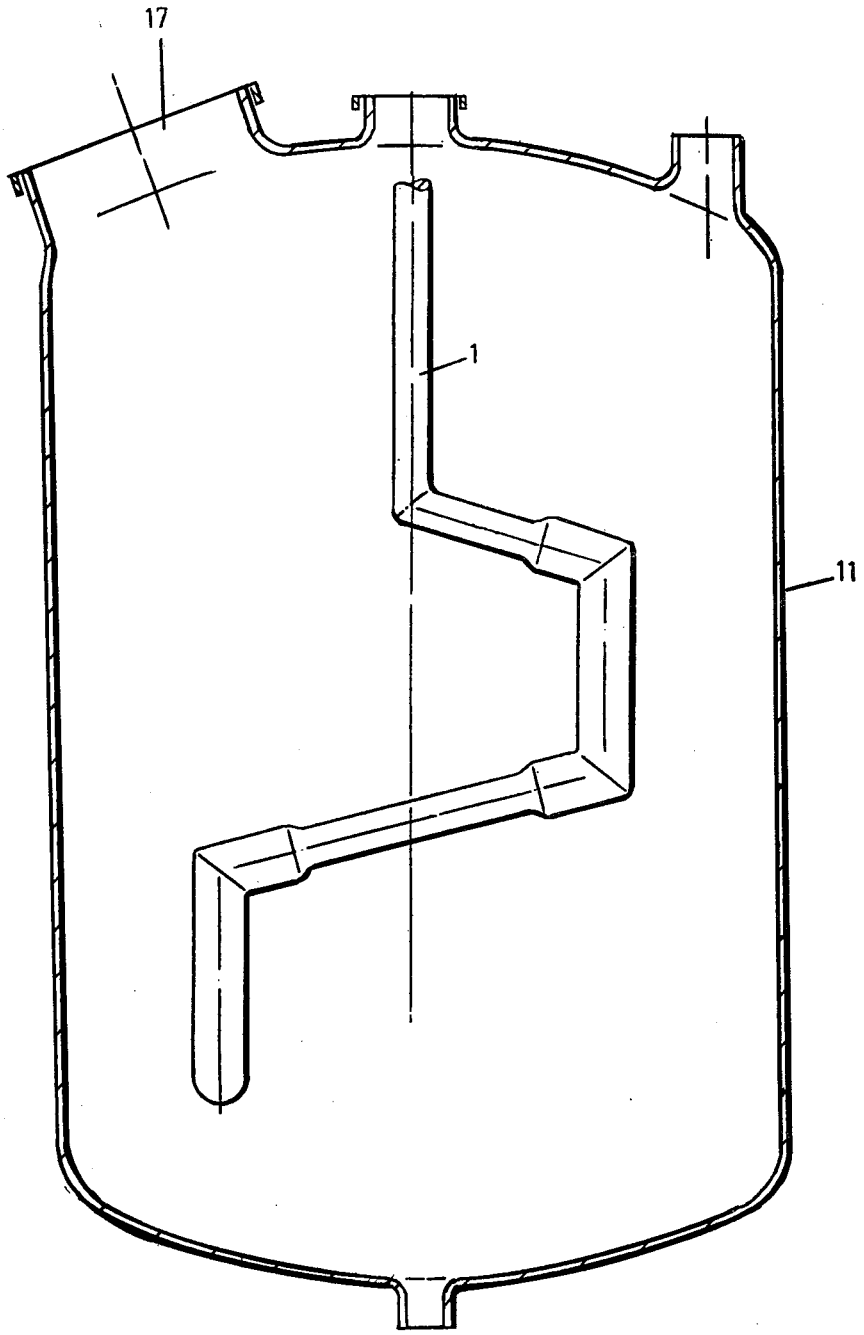

Further advantages of the agitator shown in FIGS. 3 and 4, in comparison with the agitator illustrated in FIGS. 1 and 2, are the control of higher viscosities and non-Newtonian substances in mixing, as well as more uniform shearing of products which are susceptible to shearing. The reason for this is the greater leading surface of the agitator and the surface distribution in the whole apparatus.

Figure 5:
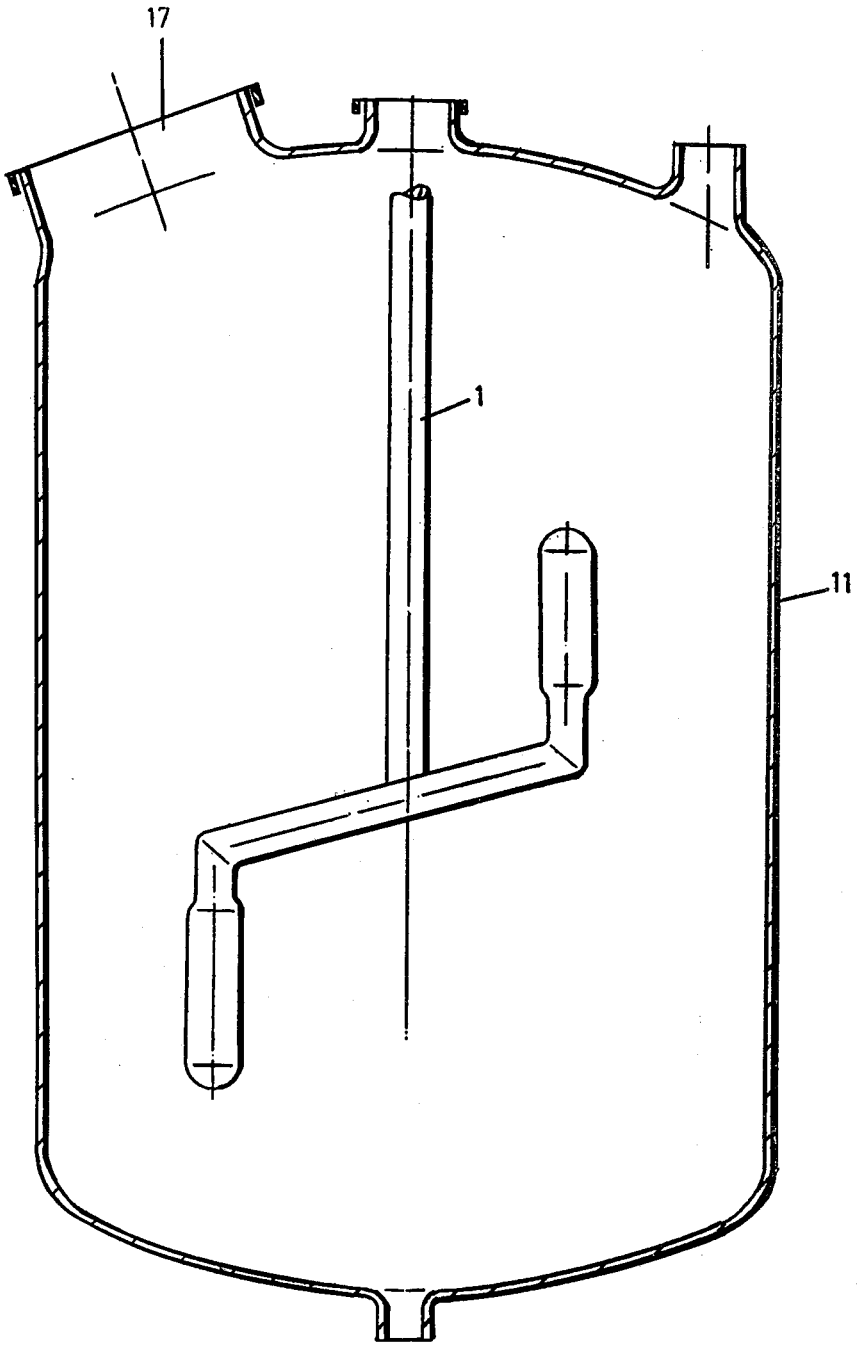
Figure 6:
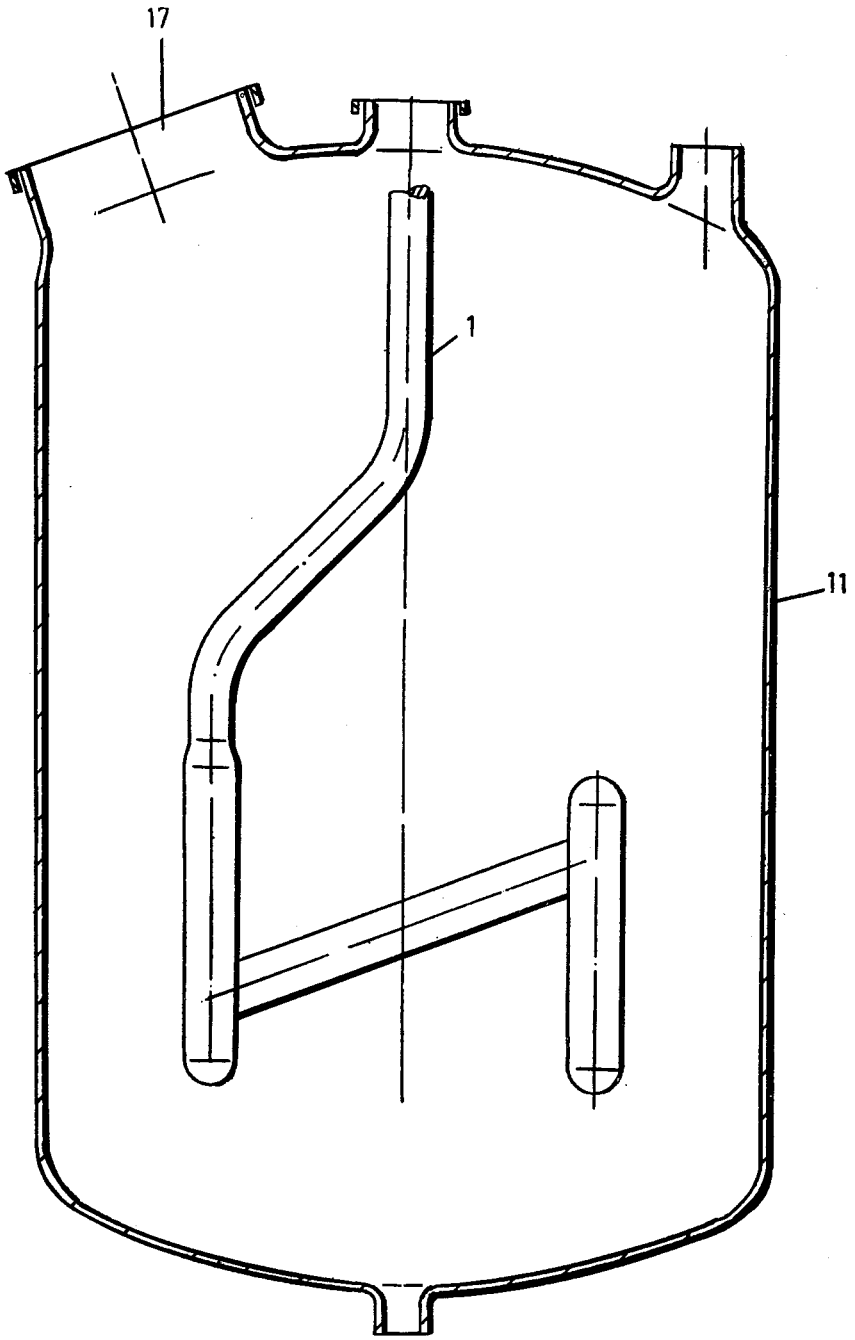

FIGS. 5 and 6 illustrate additional examples of impellers constructed of alternating vertical and at least approximately horizontal sections. In FIG. 5, one vertical section is connected to an offset portion of the agitator shaft, and the first vertical section is in turn connected to a second vertically extending agitator blade by a connection which extends approximately horizontally. In FIG. 6 the agitator shaft attaches directly to the approximately horizontal connecting piece, and one vertically extending agitator blade is attached at each end of the connecting piece. These agitators are easier to enamel and less expensive than the version shown in FIGS. 1 and 2.

Thus, it may be seen that this invention provides a variety of one piece agitators with impellers that may be threaded through relative small openings, such as manholes, in closed enameled vessels. All of these agitators can be completely covered with an enamel coating, which makes them less susceptible to corrosive attack than separable blade agitators. Moreover, since there are no joints which can loosen, they are sturdier than separable blade agitators. Those skilled in the art will appreciate that a variety of other agitators of this sort can be constructed within the scope of this invention, which is defined by the following claims.

We claim:

1. In a closed enameled vessel having a manhole opening, an agitator opening and an enameled agitator mounted in said agitator opening, said agitator comprising an agitator shaft and an impeller having a diameter larger than the largest opening in said vessel, the improvement wherein said agitator is a one piece construction, is completely enameled and is inserted into said vessel by threading the impeller through the manhole.

2. Apparauts according to claim 1 wherein the impeller comprises a segment of a ring and agitator blades attached to and extending outwardly from said segment.

3. In a closed vessel having a manhole opening therein, an agitator opening and an agitator mounted in said agitator opening, said agitator comprising an agitator shaft and an impeller having a diameter larger than the largest opening in said vessel, the improvement wherein said impeller comprises a segment of a ring and a plurality of agitator blades mounted on and extending outwardly from said ring segment.

4. Apparatus according to claim 3, wherein the lower end of said agitator shaft is offset and said ring segment is attached to the offset portion of said shaft.

5. Apparatus according to claim 4 wherein said ring segment follows the offset shaft portion in the direction of rotation of the agitator.

6. Apparatus according to claim 3 or 5 wherein said agitator is a one piece construction and is completely enameled.

7. Apparatus according to claim 2, 3, 4 or 5 wherein said ring segment has a cutout section of approximately 120°.

8. Apparatus according to claim 2, 3, 4 or 5 wherein one of said agitator blades is mounted at each end of said ring segment.

9. Apparatus according to claim 2, 3, 4 or 5 wherein said impeller comprises at least three agitator blades and said blades are mounted at least approximately symmetrically with respect to rotation.

10. Apparatus according to claim 9 wherein at least one agitator blade is mounted in a position which is displaced at a small angle from a position symmetrical with respect to rotation to the position of a neighboring agitator blade.

11. Apparatus according to claim 10 wherein said small angle is approximately 5°.

12. Apparatus according to claim 2, 3, 4 or 5 wherein the weight of at least one of said agitator blades is different from the weight of at least one other agitator blade to compensate for imbalance.

13. Apparatus according to claim 2, 3, 4 or 5 wherein said agitator blades are flattened to increase their height.

14. Apparatus according to claim 13 wherein the height of at least one of said agitator blades is different from the height of at least one other agitator blade.

15. Apparatus according to claim 1 wherein said impeller comprises alternating sections extending at least approximately horizontally and vertically.

16. Apparatus according to claim 1 wherein said impeller is C-shaped.

17. Apparatus according to claim 1 wherein said impeller is S-shaped.

18. Apparatus according to claim 16 or 17 wherein an additional vertically extending agitator blade is attached to said impeller.

* * * * *